US008439468B2

(12) United States Patent
Yokozawa et al.

(10) Patent No.: US 8,439,468 B2
(45) Date of Patent: May 14, 2013

(54) INKJET PRINT APPARATUS AND INKJET PRINT METHOD

(75) Inventors: Taku Yokozawa, Yokohama (JP); Kazuo Suzuki, Yokohami (JP); Yosuke Ishii, Kawasaki (JP); Kazuhiko Sato, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 451 days.

(21) Appl. No.: 12/634,205

(22) Filed: Dec. 9, 2009

(65) Prior Publication Data

US 2010/0156978 A1 Jun. 24, 2010

(30) Foreign Application Priority Data

Dec. 19, 2008 (JP) ..... 2008-324154

(51) Int. Cl.
*B41J 29/38* (2006.01)

(52) U.S. Cl.
USPC ..... 347/14; 347/17; 347/9

(58) Field of Classification Search ..... 347/5, 7, 347/9, 14, 17
See application file for complete search history.

(56) References Cited

U.S. PATENT DOCUMENTS

| | | | | |
|---|---|---|---|---|
| 5,966,144 | A * | 10/1999 | Edwards | 347/7 |
| 6,231,152 | B1 | 5/2001 | Sato et al. | |
| 6,499,821 | B1 | 12/2002 | Nozawa | |
| 6,655,772 | B2 | 12/2003 | Danzuka et al. | |
| 2002/0140753 | A1 * | 10/2002 | Danzuka et al. | 347/14 |
| 2003/0179255 | A1 * | 9/2003 | Mizutani et al. | 347/14 |
| 2008/0297552 | A1 | 12/2008 | Yokozawa et al. | |

FOREIGN PATENT DOCUMENTS

| | | |
|---|---|---|
| JP | 2001-088289 | 4/2001 |
| JP | 2001-113678 | 4/2001 |
| JP | 2002-355959 | 12/2002 |
| JP | 2006-341570 | 12/2006 |

* cited by examiner

*Primary Examiner* — Lam S Nguyen
(74) *Attorney, Agent, or Firm* — Fitzpatrick, Cella, Harper & Scinto

(57) ABSTRACT

In a print apparatus for performing a print by a scan of a print head with heaters generating thermal energy for ejecting ink, a temperature of the print head is detected before the scan of the print head, and when the detected temperature exceeds a threshold temperature, the print head is controlled to wait. Information relating to the cumulative number of drives of the heater in the print head is acquired and, based upon this information, the threshold temperature is changed to a lower temperature as the cumulative number of the drives increases. An excessive temperature rise of the head is restricted and also a throughput reduction is reduced as much as possible.

10 Claims, 7 Drawing Sheets

| | THRESHOLD TEMPERATURE | PRINTING TIME | | | HEAD FAILURE |
|---|---|---|---|---|---|
| | | ~$2\times10^8$ | $2\times10^8$~$3\times10^8$ | $3\times10^8$~ | |
| EMBODIMENT | STAGE CONTROL | 4minutes 9seconds | 4minutes 32seconds | 5minutes 11seconds | $5\times10^8$ |
| CONVENTIONAL EXAMPLE 1 | 80℃ | 4minutes 9seconds | 4minutes 9seconds | 4minutes 9seconds | $3.5\times10^8$ |
| CONVENTIONAL EXAMPLE 2 | 60℃ | 5minutes 11seconds | 5minutes 11seconds | 5minutes 11seconds | $5.2\times10^8$ |

FIG. 5

INKJET PRINT APPARATUS AND INKJET PRINT METHOD

BACKGROUND OF THE INVENTION

1. Field of the Invention

This invention relates to a print apparatus and a print method for causing a print head to eject ink onto a print medium for producing a print, and more particularly to a print apparatus and a print method for controlling the print head temperature, which rises due to ink ejection.

2. Description of the Related Art

Types of print heads mounted in an inkjet print apparatus include one using thermal energy to eject ink. Such a type of print head typically comprises a highly concentrated arrangement of a plurality of fluid paths for delivering ink and a plurality of print elements each comprising an electrothermal transducing element (heater) for causing film-boiling of the ink in the fluid path.

However, the print head structured as described above accumulates more and more heat as ink ejections are increasingly repeated, and this heat accumulation may present a problem. Such a heat-accumulation problem tends to arise more markedly upon aiming at realizing the higher-speed and higher-density output.

For example, as heat accumulates in the print head, bubbles occur and grow in the ink. The growing bubbles obstruct ink ejection from the ejection port.

The temperature of the print head may sometimes reach one hundred and several tens of degrees Celsius. As a result, there may be the possibility that a plastic component forming part of the print head is thermally deformed, abrupt thermal expansion causes peeling of a bonding part, or the ink remaining near the heater is scorched.

In addition, the temperature rise may possibly give rise to a deterioration of the fluid contact properties between the ink and the components of the head. In this event, electrode wiring is corroded, which causes electric damage to the print head, or the ink erodes the bonding area between the nozzle and the substrate which causes reduced contact properties. An area where a nozzle is formed may be deformed. As a result, there are many cases where the head life is reduced.

For the purpose of avoiding the detrimental effects resulting from such a heat accumulation problem, there is known a method for controlling the print method by detecting the temperature of the print head during the print operation and then comparing the detected temperature with a predetermined threshold. For example, a method is known in which, based on a temperature detected at the present moment and the image data for the next main scan, the temperature of the print head after completing the next main scan is estimated, and then a waiting time is determined in accordance with the estimated temperature (see Japanese Patent Laid-Open No. 2001-113678, for example).

However, with this method, the throughput is significantly reduced as compared with the case of not providing the waiting time. If the threshold temperature at which the waiting time is activated is set high, this makes it possible to decrease the frequency of carrying out the setting of the waiting time so as to restrict a reduction in the throughput. However, this increases the risk of the print head suffering a head failure due to an excessive temperature rise.

In this connection, in many cases, the phenomenon of failure of the print head is caused by a complex combination of factors, such as the materials of the components of the print head, the ink formulation and the mechanical structure of the print head. In one case the print head breaks down when the head temperature reaches one hundred and several tens of degrees Celsius. In another case the print head breaks down when the head temperature reaches a level of a few tens of degrees Celsius. In yet another case the print head momentarily breaks down due to temperature-induced deformation or the like, but in another case the temperature-induced phenomenon, such as ink erosion or the like, moderately accelerates. Because of this, a threshold temperature when a waiting time is provided between main scans for preventing the excessive temperature rise is typically set in such a manner as to prevent one of the phenomena, which are caused by at various temperatures and lead to head failures, from being caused at the lowest temperature. In this case, a great effect is provided for controlling the temperature to prevent the occurrence of a head failure. In spite of this, even in a process for forming a low duty image, a waiting time may be generated just by a slight increase in head temperature, resulting in a significant reduction in throughput.

The present invention has been made in light of the foregoing, and an object of the present invention is to provide an inkjet print apparatus and an inkjet print method which are capable of restricting an excessive temperature rise in a print head and minimizing a reduction in throughput.

SUMMARY OF THE INVENTION

To attain this object, the present invention provides a print apparatus for performing a print by a scan of a print head with heaters generating thermal energy for ejecting ink. The print apparatus comprises a detecting unit configured to detect a temperature of the print head before the scan of the print head, a waiting unit configured to make the print head wait when the temperature detected by the detecting unit exceeds a threshold temperature, an acquiring unit configured to acquire information relating to the cumulative number of drives of the heaters in the print head, and a changing unit configured to change the threshold temperature to a lower temperature as the cumulative number of the drives is the larger, based upon the information relating to the cumulative number of the drives.

According to the above configuration, as the cumulative number of the drives of the heater in the print head is the larger, the threshold temperature can be changed into the lower temperature. Therefore, during the period when ink erosion or the like can be assumed to have little effect, the threshold temperature at which the waiting time is activated can be set relatively high on the assumption of only the event of a head failure such as thermally-induced deformation or the like momentarily taking place. On the other hand, when the usage history of the print head is long, ink erosion or the like grows to increase concerns that a head failure is caused. Because of this, a decrease in the threshold temperature makes it possible to prevent the print head from breaking down due to ink erosion or the like. In consequence, the excessive temperature rise of the print head can be effectively restricted and also a reduction in throughput can be minimized.

Further features of the present invention will become apparent from the following description of exemplary embodiments (with reference to the attached drawings).

BRIEF DESCRIPTION OF THE DRAWINGS

FIG. 5 is a table illustrating the time required for printing a page and the cumulative number of ejections in which a head failure takes place in the first embodiment of the present invention;

DESCRIPTION OF THE EMBODIMENTS

[First Embodiment]

An embodiment according to the present invention will be described below in detail with reference to the accompanying drawings. The term "print" in the specification includes not only the formation of significant information such as text or graphics on a print medium, but also the formation of non-significant information on a print medium. Also, the term "print medium" represents not only paper used in a typical print apparatus, but also an ink receptive item such as cloth, a plastic film, a metal plate, glass, ceramics, wood, leather or the like. Also, the term "ink" should be widely interpreted as in the case of the definition of the term "print", and is assumed as an item which can form an image, design, pattern or the like by being applied to a print medium.

Figure 1:
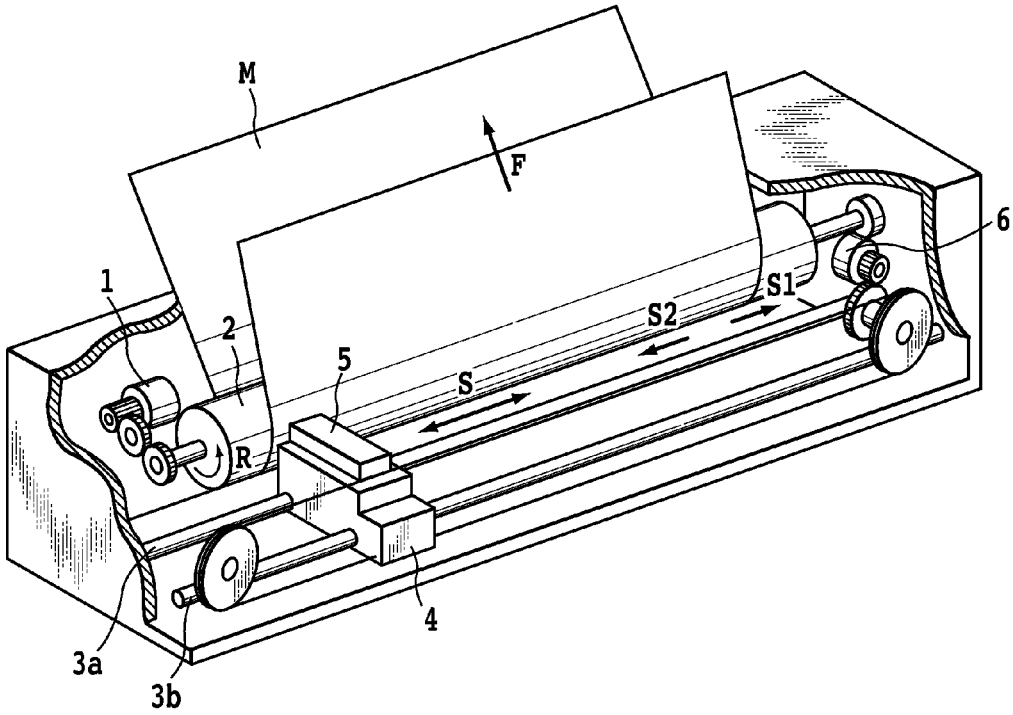
FIG. 1 is a schematically perspective diagram illustrating the structure of an inkjet print apparatus according to a first embodiment of the present invention.

FIG. 1 is a schematic perspective view illustrating the internal mechanism of an inkjet print apparatus which can be suitably employed in the present embodiment. A line feed motor 1 is driven in order to rotate a platen roller 2 in the direction indicated by the arrow R in FIG. 1 such that a print medium M is fed in the direction indicated by the arrow F. Guide shafts 3*a* and 3*b*, which are disposed parallel to each other, extend in a direction at right angles to the feeding direction F (sub-scanning direction) of the print medium M. A carriage 4 (scanning unit) on which an inkjet print head 5 is mounted is driven by a carriage motor 6 to move in a reciprocating motion (reciprocating scan) in the direction indicated by the arrows S in FIG. 1 (main scanning direction) while being guided and supported by the guide shafts 3*a* and 3*b*. The print head 5 mounted on the carriage 4 executes ink ejections in accordance with print data during the scanning of the moving carriage 4 for producing a print on the print medium. The present embodiment employs the so-called bidirectional print scheme in which a print is produced on a print medium by ejecting ink either when the print head 5 moves along its outward path or when it moves along its return path. It should be noted that the operation of the print head 5 ejecting ink while scanning to produce a print on a print medium is also referred to as "print scan" in the following description. After a print scan has been performed by the print head 5, the print medium M is fed by the feed motor 1 by a predetermined amount.

The inkjet print head 5 used in the present embodiment comprises 1280 ejection ports arranged at a pitch of 1200 dpi (dot/inch, reference value) in the sub-scanning direction. An electrothermal transducer (heating element or heater) is provided in an ink flow path (fluid path) making fluid connection to each ejection port for generating heat upon reception of an electrical signal generated in accordance with image data. The electrothermal transducer generates thermal energy by receiving a driving signal, whereby the ink is locally heated to cause film boiling. The pressure produced at this stage causes the ejection of ink droplets from the ejection port. In the following description, the ejection port for ejecting ink, the fluid path making fluid connection to the ejection port, and the electrothermal transducer provided in the fluid path are referred to as a "nozzle (print element)". In the print head 5, a diode sensor 50 is provided on the substrate on which the electrothermal transducer is mounted. The diode sensor 50 serves as a head-temperature detecting unit for detecting the temperature of the print head 5.

Figure 2:
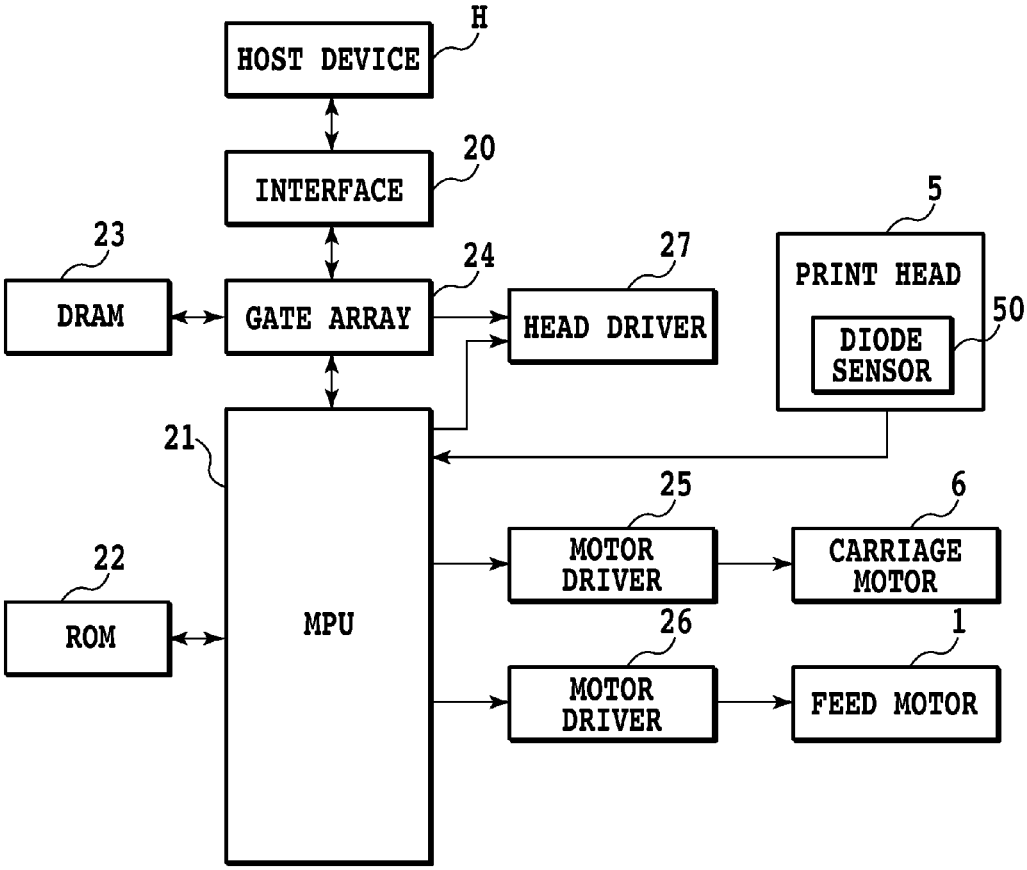
FIG. 2 is a block diagram illustrating the configuration of a control system of the inkjet print apparatus according to the first embodiment of the present invention.

FIG. 2 is a block diagram illustrating the configuration of the control system of the inkjet print apparatus in the present embodiment. An interface 20 is provided for transmission/reception of data such as image data, control commands and the like between a host device H and the main body of the inkjet print apparatus. An MPU 21 performs various kinds of processing such as operations, determinations, setting and the like, and executes various types of control for the entire print apparatus. A ROM 22 stores programs and fixed data required for the control performed by the MPU 21. A DRAM 23 temporarily stores various items of data (print data to be supplied to the print head 5, and the like). The DRAM 23 is used as a work area for the processing performed by the MPU 21. It should be noted that the MPU 21, the ROM 22 and the DRAM 23 form a control unit, a waiting control unit, a threshold temperature reduction unit and a waiting time setting unit of the present invention.

A gate array 24 controls the supply of print data to the print head 5. In addition, the gate array 24 controls data transfer between the interface 20, the MPU 21 and the DRAM 23. Motor drivers 25 and 26 respectively drive the carriage motor 6 and the feed motor 1. A head driver 27 drives the print head 5. The MPU 21 receives data (temperature value) output from a diode sensor 50 which detects the temperature of the print head 5.

A sequence of the print according to the present embodiment is specifically described using the aforementioned print apparatus.

Figure 3:
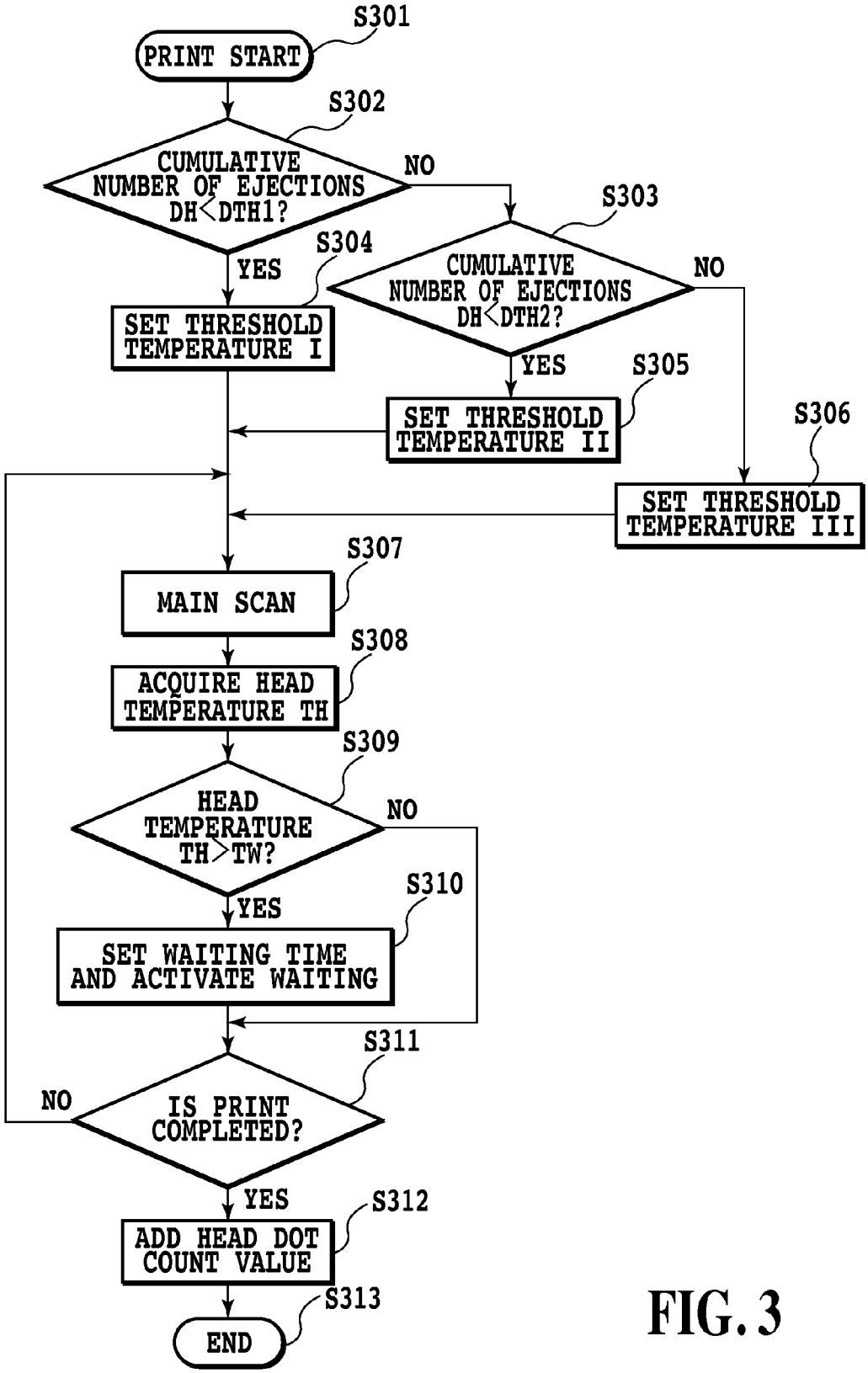
FIG. 3 is a flow chart illustrating an image print sequence according to the first embodiment of the present invention.

FIG. 3 is a flowchart describing a series of process steps executed by the MPU 21 for printing the image on one page in the print apparatus of the present embodiment. Upon start of print (step S301), the MPU 21 receives image data including control data from the host device H through the interface 20 and the gate array 24.

Next, the threshold temperature setting unit determines a threshold temperature on the basis of information relating to usage history. The MPU 21 reads the cumulative number of ejections from the print head (hereinafter, also referred to as "head dot count value DH") measured by the usage history measuring unit stored in the DRAM 23. It should be noted that the number of ejections of the print head corresponds to the drive number of the heaters in the print head. Then, the MPU 21 compares the cumulative number of ejections thus read with a predetermined cumulative number of ejections (hereinafter, also referred to as "dot count threshold DTH1") which have been previously stored in the ROM 22 (step S302). At this stage, when the head dot count value DH is lower than the dot count threshold DTH1, the procedure goes to step S304 to set, in the DRAM 23, a threshold temperature I at which the waiting control is executed. On the other hand, when the head dot count value DH exceeds the dot count threshold DTH1, in step S303 the MPU 21 compares the head dot count value DH with a predetermined cumulative number of ejections (hereinafter, also referred to as "dot count threshold DTH2") which has been stored in the ROM 22. At this stage, when the head dot count value DH is lower than the dot count threshold DTH2, a threshold temperature II is set in the DRAM 23 (step S305). On the other hand, when the head dot count value DH exceeds the dot count threshold DTH2, a threshold temperature III is set in the DRAM 23 (step S306). Through this series of operations a threshold value is set.

Upon the completion of the setting of the threshold temperature, the main scanning is started (step S307) to initiate the print of an image. In this process, the MPU 21 acquires the maximum reachable temperature of the print head 5 in one (previous) main scan (hereinafter, also referred to as "maximum head temperature TH") as a detected temperature from the diode sensor 50 (step S308). Then, the MPU 21 compares the detected temperature with the threshold temperature set in the DRAM 23 in steps S304 to S306 (hereinafter, also referred to as "waiting execution temperature TW") (step S309). When it is determined that the maximum head temperature TH is higher than the waiting execution temperature TW, the MPU 21 executes the waiting process for a predetermined waiting time set by the waiting time setting unit between one (previous) print scan and the next (present) print scan, that is, before the next (present) print scan (step S310). This waiting time is predetermined on the basis of the head dot count value DH. That is, in the present embodiment, the higher the head dot count value DH, the longer the waiting time becomes. Then, upon completion of the print of all image data for one page (step S311), the MPU 21 adds the total number of ejections for the page to the head dot count value DH stored in the DRAM 23 in order to measure usage history (step S312). Then, the print operation is terminated (step S313).

Figure 4:
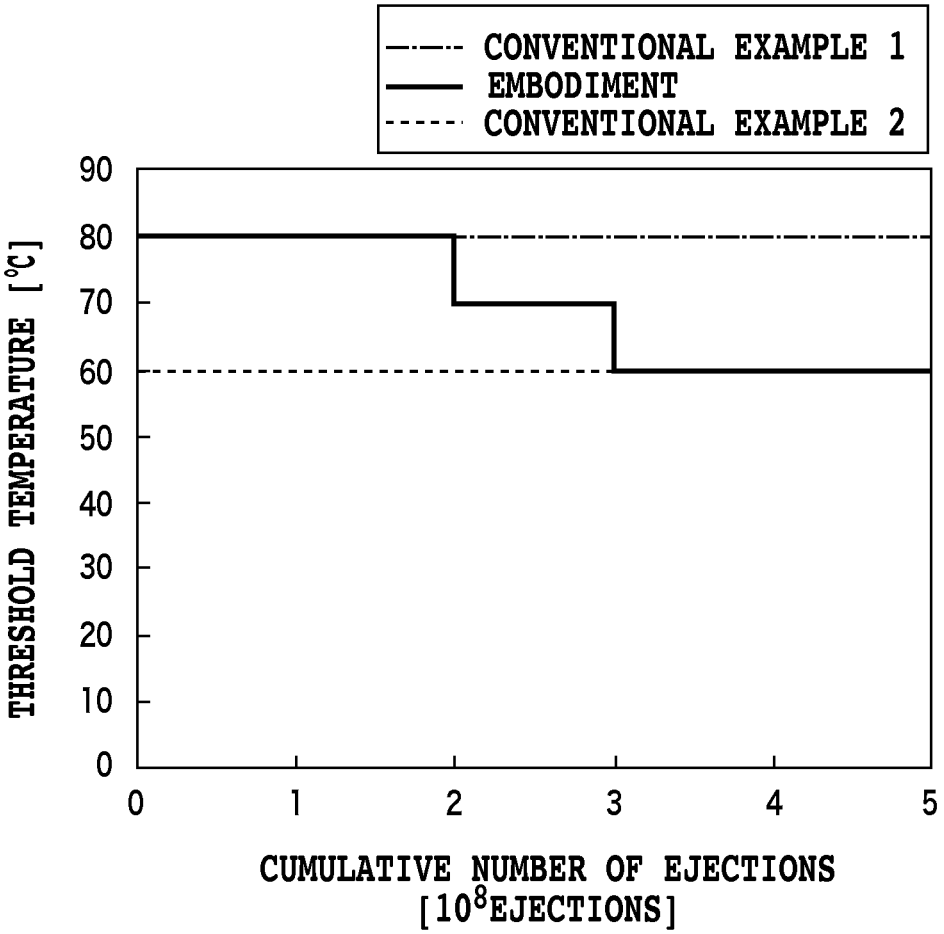
FIG. 4 is a graph illustrating the relationship between the cumulative number of ejections and a threshold temperature at which waiting control is started according to the first embodiment of the present invention.

FIG. 4 is a graph showing the relationship between the threshold temperature for the waiting control set in the present embodiment and the cumulative number of ejections from the print head. In the present embodiment, satisfactory fluid contact properties between the components of the print head and the ink are provided until the cumulative number of ejections of the print head reaches about $2\times10^8$ ejections, so that there is no necessity to consider adverse effects such as ink erosion or the like. For this reason, the threshold temperature at which the waiting control is started is set to a higher temperature of 80° C. (threshold temperature I) on the assumption of only the event of a head failure momentarily taking place. After the cumulative number of ejections of the print head has reached about $2\times10^8$ ejections, the print head is held for a long period of time in high temperature conditions. This induces the growth of ink erosion, resulting in an increased risk of causing a head failure to take place. To avoid this, the threshold temperature at which the waiting control is started is decreased step by step. Specifically, the threshold temperature is set at 70° C. up to $3\times10^8$ ejections (threshold temperature II), and then it is set at 60° C. (threshold temperature III). Such temperature setting makes it possible to effectively restrict an excessive temperature rise in the head so as to restrain the growth of ink erosion.

FIG. 4 also shows graphs of the relationship between the threshold temperature and the cumulative number of ejections of the print head in the cases of conventional examples where the threshold temperature at which the waiting control is started is set at 80° C. (conventional example 1) and 60° C. (conventional example 2) at all times irrespective of the head usage history. In the case of the threshold temperature set at 80° C. at all times, it is possible to prevent the event of ahead failure being momentarily caused and also to restrict the reduction in throughput. However, it is difficult to prevent a head failure from being caused by the growth of a phenomenon depending on the head usage history such as ink erosion or the like. On the other hand, in the case of the threshold temperature set at 60° C. at all times, it is possible to prevent the event of a head failure resulting from the growth of a phenomenon depending on the head usage history such as ink erosion or the like. However, the throughput is seriously decreased because a waiting time between main scans is provided even if the head temperature only slightly increases.

FIG. 5 is a table showing the print time required per sheet and the cumulative number of ejections of the print head at the time when a head failure takes place when an image with a print duty of 50% is printed in A0 size by a multi-path print method of a four-path. FIG. 5 also shows the results of the cases illustrated in FIG. 4. In one case a control is implemented for decreasing the threshold temperature step-by-step. In another case, as conventional example (conventional example 1) the threshold temperature at which the waiting control is started is set at 80° C. all the times irrespective of the head usage history. In yet another case (conventional example 2) the threshold temperature is set at 60° C. all the times.

As seen from FIG. 5, in the case of performing the threshold-temperature control of the present embodiment, since the threshold temperature is set at 80° C. until the cumulative number of ejections of the print head reaches about $2\times10^8$ ejections, the print time per sheet was 4 minutes 9 seconds as in the case of conventional example 1. On the other hand, in conventional example 2, since the threshold temperature is set at 60° C., the throughput was reduced and the print time per sheet was 5 minutes 11 seconds. As the cumulative number of ejections of the print head increases, the threshold temperature is decreased step by step by the threshold-temperature control of the present embodiment. For this reason, after the cumulative number of ejections of the print head has reached $3\times10^8$ ejections, the threshold temperature is set to 60° C. The print time per sheet in this case was 5 minutes 11 seconds as in the case of conventional example 2. On the other hand, in conventional example 1, because the threshold temperature is always set at 80° C., the print time per sheet was 4 minute 9 seconds as in the case of a low cumulative number of ejections of the print head.

When the aforementioned types of control were performed, a head failure took place when the cumulative number of ejections of the print head had reached about $3.5\times10^8$ ejections in conventional example 1. On the other hand, in conventional example 2, a head failure did not take place until the cumulative number of ejections of the print head had reached about $5\times10^8$ ejections, and then a head failure resulted when the cumulative number of ejections had reached about $5.2\times10^8$ ejections. By contrast, when the threshold temperature is decreased step by step by the threshold-temperature control of the present embodiment, a head failure took place when the cumulative number of ejections had reached about $5\times10^8$ ejections, because the growth of ink erosion or the like had been successfully restrained.

As described above, in the present embodiment, during the period when the usage history of the print head is short and therefore ink erosion or the like can be assumed to have little effect, the threshold temperature can be set high to prevent a reduction in throughput, making it possible to achieve a faster print. During the period when the usage history of the print head is long and the risk of head failure is increased by the growth of ink erosion or the like because the print head is kept in high temperature conditions for a long period of time, the threshold temperature can be decreased step by step to restrict the head temperature, making it possible to achieve an enhanced capability of avoiding the head failure. In consequence, it is possible to achieve an increase in head life by not only avoiding a reduction in throughput as much as possible, but also preventing the head failure. It should be noted that in the present embodiment, the usage history of the print head is estimated from the cumulative number of ejections. However, the present invention may estimate the usage history of the print head based upon the other information to decrease the threshold value step by step. For example, by providing a replacement detecting unit configured to detect replacement of the print head (for example, unit configured to detect electrical connection between the print head and the carriage) and a timer for counting time after the print head is replaced, the threshold temperature may be set based upon the cumulative usage time of the print head. Or the threshold temperature may be set based upon the cumulative number of the print sheets. In addition, the information relating to the usage history is configured to be reset at timing when the replacement detecting unit detects the replacement of the print head. Further, in the present embodiment, when the detected head temperature exceeds the threshold temperature, wait time is set. In such a configuration, the wait time is set the longer as the detected head temperature (specially maximum head temperature TH detected at the previous main scanning) is the higher so that the print is started at timing when the head temperature is lower than a predetermined temperature. Further, by providing a unit configured to detect an environment temperature of the print head, the wait time may be set the longer as the environment temperature is the higher. In addition, it is possible to make the print by the print head wait simply by a predetermined time, not depending on the print head temperature. The head temperature to be detected is not limited to the maximum reach temperature during the previous print scanning, but may be a temperature detected between the previous print scan and the present print scan.

This embodiment employs the control of changing the threshold temperature in three stages from 80° C. to 60° C., but optimal threshold temperatures and the number of stages may be selected according to conditions of the structure of the print head, the ink formulation and/or the like. The threshold temperature maybe controlled to be varied in further increased stages or the temperature may be more greatly decreased in order to achieve temperature restricting control allowing for the prevention of head failure.

This embodiment has described the control of changing only the threshold temperature at which the waiting control is started, but the waiting time may be controlled to be increased concurrently with a reduction in the threshold temperature in order to more enhance the temperature restriction effect.

As described above, during the period when the usage history of the print head is short and ink erosion or the like can be assumed to have little effect, a threshold temperature at which the waiting time is activated can be set on the assumption of only the event of a head failure momentarily taking place due to thermally-induced deformation or the like. On the other hand, when the usage history of the print head is long, ink erosion or the like grows, raising concerns that a head failure is caused. Because of this, a step-by-step decrease in the threshold temperature makes it possible to produce the effect of advantageously preventing the print head from breaking down due to ink erosion or the like. As a result, during the period when a phenomenon leading to a head failure does not occur as long as the head temperature reaches about one hundred and several tens of degrees Celsius, a higher threshold temperature can be set to prevent a reduction in throughput, resulting in faster printing. On the other hand, in the period when a usage history of the print head is long and a phenomenon leading to a head failure tends to occur at a level of a few tens of degrees Celsius, the threshold temperature is decreased step by step to restrict the head temperature, resulting in an enhanced capability of avoiding head failure.

In addition, the measurement of the usage history is made on the basis of the temperature of the print head or in accordance with print duty. As a result, more precise ascertainment of the extent to which ink erosion or the like affects is made possible. In turn, the timing of a decrease in threshold temperature can be optimized, making it possible to perform flexible control depending on an individual usage state.

[Second Embodiment]

In the first embodiment, the cumulative number of ejections of the print head (head dot count value DH) is counted irrespective of the temperature of the print head, and the threshold temperature is changed in accordance with the counted number. In the second embodiment, the number of ejections from the print head in a state of a predetermined temperature or higher is counted and the threshold temperature is controlled to be decreased in accordance with the counted number.

Figure 6:
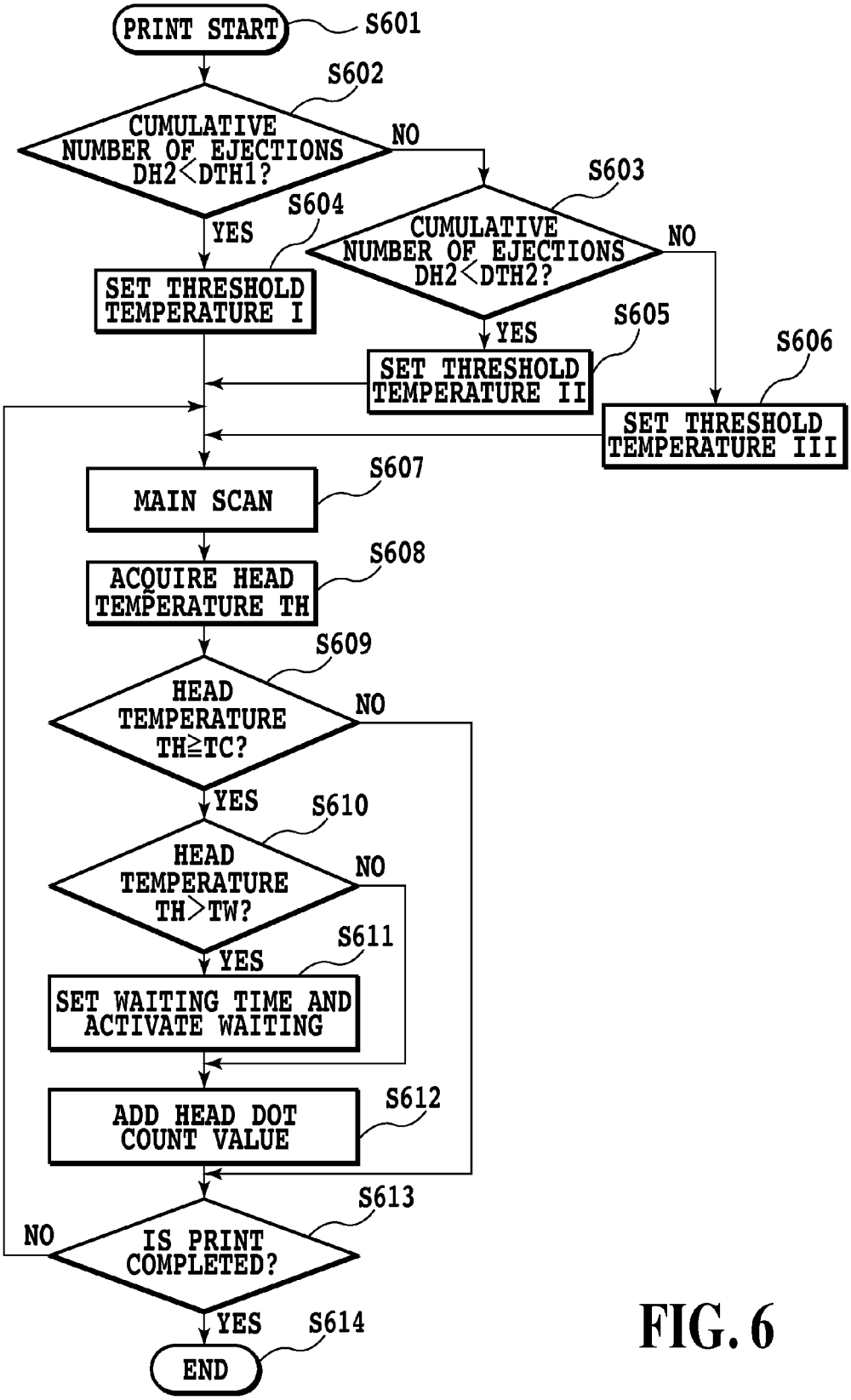
FIG. 6 is a flow chart illustrating an image print sequence according to a second embodiment of the present invention.

FIG. 6 is a flowchart describing a series of process steps executed by the MPU 21 for printing the image for one page in the print apparatus of the second embodiment. Upon start of print (step S601), the MPU 21 receives image data including control data from the host device H through the interface 20 and the gate array 24.

Next, the MPU 21 reads the cumulative number of ejections from the print head at a predetermined temperature or higher (hereinafter, also referred to as "head dot count value DH2") measured by the usage history measuring unit stored in the DRAM 23. Then, the MPU 21 compares the cumulative number of ejections thus read with a predetermined cumulative number of ejections (hereinafter, also referred to as "dot count threshold DTH1") which have been previously stored in the ROM 22 (step S602). At this stage, when the head dot count value DH2 is lower than the dot count threshold DTH1, the procedure goes to step S604 to set a threshold temperature I at which the waiting control is activated, in the DRAM 23. On the other hand, when the head dot count value DH2 exceeds the dot count threshold DTH1, the procedure goes to step S603 to compare the head dot count value DH2 with a predetermined cumulative number of ejections (hereinafter, also referred to as "dot count threshold DTH2") which has been prestored in the ROM 22. At this stage, when the head dot count value DH2 is lower than the dot count threshold DTH2, a threshold temperature II is set in the DRAM 23 (step S605). On the other hand, when the head dot count value DH2 exceeds the dot count threshold DTH2, a threshold temperature III is set in the DRAM 23 (step S606).

Upon completion of the setting of the threshold temperature, the main scanning is started (step S607) to initiate the print of an image. In this process, the MPU 21 acquires the maximum reachable temperature of the print head 5 in one (previous) main scan (hereinafter, also referred to as "maximum head temperature TH") as a detected temperature from the diode sensor 50 (step S608). Then, the MPU 21 compares the acquired maximum head temperature TH with a predetermined temperature (hereinafter, also referred to as "dot count temperature TC") which has been in advance stored in the ROM 22 (step S609). The dot count temperature TC is 60° C. in the present embodiment. When it is determined that the maximum head temperature TH is equal to or more than the dot count temperature TC, the MPU 21 compares the maximum head temperature TH with the threshold temperature set in the DRAM 23 (hereinafter, also referred to as "waiting execution temperature TW") (step S610). When it is determined that the maximum head temperature TH is higher than the waiting execution temperature TW, the MPU 21 sets a predetermined waiting time before starting the next main scan, and executes the waiting process for a predetermined time (step S611). Then, the MPU 21 adds the number of ejections from the print head when the maximum head temperature TH is equal to or more than the dot count temperature TC, to the head dot count value DH2 stored in the DRAM 23 (step S612). Then, upon completion of printing all the image data for one page (step S613), the print operation is terminated (step S614).

Figure 7:
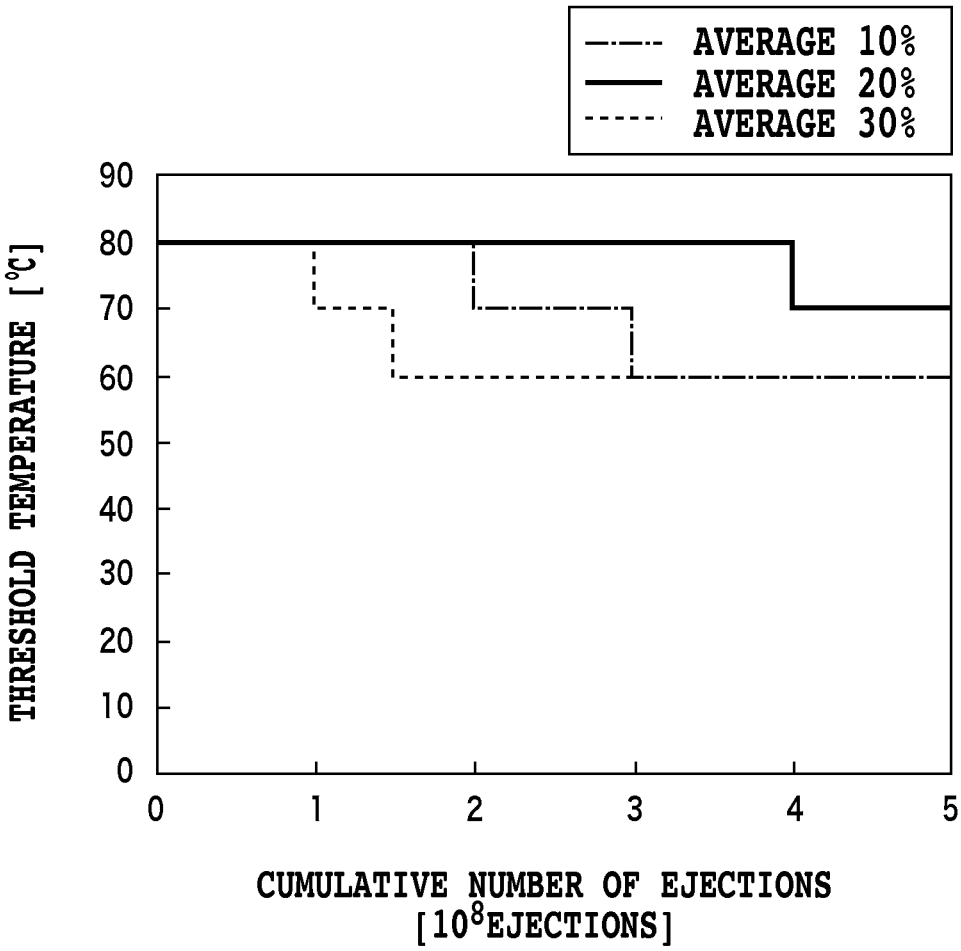
FIG. 7 is a graph illustrating the relationship between the cumulative number of ejections and a threshold temperature at which waiting control is started in the second embodiment of the present invention.

FIG. 7 is a graph showing the relationship between the threshold temperature at which the waiting control is started and the cumulative number of ejections from the print head when images with duties of average 10%, average 20% and average 30% are respectively continued to be printed in the second embodiment. In the control according to the second embodiment, the number of ejections from the print head at the dot count temperature TC (60° C.) or higher is counted and then a threshold temperature is set to 80° C. until the counted number reaches $0.7\times10^8$ ejections. Then, in the period from when the counted number reaches $0.7\times10^8$ ejections to when it reaches $1\times10^8$ ejections, the threshold temperature is set to 70° C. Then, after the counted number exceeds $1\times10^8$ ejections, the threshold temperature is set to 60° C. In this case, when the image with a duty of average 30% was continued to be printed, the head temperature was equal to or higher than 60° C. with relatively high frequency, and the counted number reached $0.7\times10^8$ ejections at the time when the cumulative number of ejections was $1\times10^8$ ejections. Accordingly, the threshold temperature was changed from 80° C. to 70° C. at the time when the cumulative number of ejections reached $1\times10^8$ ejections. Likewise, since the counted number reached $1.0\times10^8$ ejections at the time when the cumulative number of ejections was $1.5\times10^8$ ejections, the threshold temperature was changed from 70° C. to 60° C. When the image with a duty of average 20% was continued to be printed, the counted number reached $0.7\times10^8$ ejections and $1\times10^8$ ejections respectively at the time when the cumulative number of ejections was $2\times10^8$ ejections and $3\times10^8$ ejections. Accordingly, the threshold temperature was changed from 80° C. to 70° C. and then from 70° C. to 60° C. That is, a print duty in a predetermined area and the number of driving signals applied in the print duty are linked with each other and measured.

Further, in the control when the image with a duty of average 10% was continued to be printed, the head temperature was equal to or higher than 60° C. with relatively low frequency, and the counted number did not reach $0.7\times10^8$ ejections until the cumulative number of ejections reached $4\times10^8$ ejections. Accordingly, the threshold temperature was changed to 70° C. at the time when the cumulative number of ejections was $4\times10^8$ ejections.

In this embodiment, the dot count temperature TC is equal to or lower than the threshold temperature III. However, the present invention is not limited to values in such a relationship. Specifically, a value of the dot count temperature TC may be larger than the thresholds I, II and III, and the threshold temperature and the dot count temperature may be unrelated to each other.

Specifically, in the present invention, the number of ejections is counted only when the print head ejects ink in a high-temperature range where the fluid contact properties between the ink and the components of the head are easily impaired. Execution of the process of changing the threshold temperature in accordance with the counted number makes it possible to vary the waiting control at optimum timing in response to a growth state of ink erosion or the like in an individual print head, without depending on the cumulative number of ejections. For example, when an image with a duty of average 30% is continued to be printed, the print head is held in a high-temperature condition at high frequency, so that the growth of ink erosion or the like accelerates to increase a risk of head failure. Accordingly, in the second embodiment, the threshold temperature at which the waiting control is started is controlled to be decreased from at the time when the cumulative number of ejections reaches $1\times10^8$ ejections, thereby advancing the timing of restricting the head temperature. On the other hand, when an image with a duty of average 10% is continued to be printed, the temperature of the print head rises at low frequency, so that ink erosion or the like is not accelerated. Accordingly, in the control of the second embodiment, the threshold temperature at which the waiting control is started is not decreased until the cumulative number of ejections reaches $4\times10^8$ ejections, thereby retarding the timing for prevention of a reduction in throughput for a long period of time. In this manner, the measurement of the usage history in accordance with the temperature of the print head makes it possible to more precisely ascertain the extent to which ink erosion or the like affects. For this reason, the timing of a decrease in threshold temperature can be optimized, making it possible to perform flexible control depending on an individual usage state.

The second embodiment has described the control of decreasing the threshold temperature in accordance with a counted number acquired by counting the number of ejections from the print head at a predetermined temperature or higher. However, in the present invention, the presence/absence of the counting of the number of ejections may not be determined from the temperature of the print head. For example, a print duty in a predetermined area may be determined, and then the number of ejections at a predetermined print duty or higher may be counted. Alternatively, a lapse of time during which the temperature of the print head is at a predetermined temperature or higher may be counted. The usage history based on the temperature of the print head may be measured to precisely ascertain individual usage history, thereby executing the threshold temperature control at optimum timing.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-324154, filed Dec. 19, 2008, which is hereby incorporated by reference herein in its entirety.

What is claimed is:

1. A print apparatus for performing a print by a scan of a print head with heaters generating thermal energy for ejecting ink, comprising:

a detecting unit configured to detect a temperature of the print head before the scan of the print head;

a waiting unit configured to make the print head wait when the temperature detected by the detecting unit exceeds a threshold temperature;

an acquiring unit configured to acquire usage history information relating to the cumulative number of drives of the heaters since the print head was initially used; and a setting unit configured to set the threshold temperature based upon the usage history information relating to the cumulative number of the drives.

2. The print apparatus according to claim 1, wherein the waiting unit is configured to lengthen a waiting time of the print head as the temperature increases.

3. The print apparatus according to claim 1, further comprising a replacement detecting unit configured to detect replacement of the print head, wherein the acquiring unit is configured to reset the cumulative number of the drives in response to an event that the print head is replaced.

4. The print apparatus according to claim 1, wherein the acquiring unit is configured to acquire the usage history information relating to the cumulative number of the drives based upon the number by which the heaters are driven when the temperature is equal to or higher than a predetermined temperature.

5. The print apparatus according to claim 1, wherein the acquiring unit is configured to acquire the usage history information relating to the cumulative number of the drives based upon the number by which the heaters are driven when a print duty in a predetermined region is equal to or more than a predetermined value.

6. The print apparatus according to claim 1, wherein the setting unit is configured to set the threshold temperature to be higher, in the case that the cumulative number of the drives is a first number, than the threshold temperature to be set in the case that the cumulative number of the drives is a second number higher than the first number.

7. The print apparatus according to claim 1, wherein the setting unit is configured to set the threshold temperature to be lower as the cumulative number of the drives increases.

8. A print apparatus for performing a print by a scan of a print head with heaters generating thermal energy for ejecting ink, comprising:

a detecting unit configured to detect a temperature of the print head before the scan of the print head;

a waiting unit configured to make the print head wait when the temperature detected by the detecting unit exceeds a threshold temperature;

an acquiring unit configured to acquire information relating to the cumulative time since the print head was initially used; and a setting unit configured to set the threshold temperature based upon the information relating to the cumulative time.

9. A print apparatus for performing a print by a scan of a print head with heaters generating thermal energy for ejecting ink, comprising:

a detecting unit configured to detect a temperature of the print head before the scan of the print head;

a waiting unit configured to make the print head wait when the temperature detected by the detecting unit exceeds a threshold temperature;

an acquiring unit configured to acquire usage history information relating to the cumulative number of sheets of a print medium printed by the print head since the print head was initially used; and a setting unit configured to set the threshold temperature based upon the information relating to the cumulative number of the sheets.

10. A print method for performing a print by a scan of a print head with heaters generating thermal energy for ejecting ink, comprising:

a step of detecting a temperature of the print head before the scan of the print head;

a step of making the print head wait when the detected temperature exceeds a threshold temperature;

a step of acquiring usage history information relating to the cumulative number of drives of the heater since the print head was initially used; and a step of setting the threshold temperature based upon the usage history information relating to the cumulative number of the drives.

* * * * *